US005212967A

United States Patent [19]

Shibata et al.

[11] Patent Number: 5,212,967

[45] Date of Patent: May 25, 1993

[54] AUTOMATIC STITCH ADJUSTING MECHANISM FOR CIRCULAR KNITTING MACHINE

[75] Inventors: Takao Shibata, Osaka; Hiromasa Nagai, Hyogo, both of Japan

[73] Assignee: Precision Fukuhara Works, Ltd., Japan

[21] Appl. No.: 915,933

[22] Filed: Jul. 17, 1992

Related U.S. Application Data

[63] Continuation-in-part of Ser. No. 712,465, Jun. 10, 1991, abandoned.

[51] Int. Cl.[5] ..... D04B 15/32

[52] U.S. Cl. ..... 66/55; 66/27

[58] Field of Search ..... 66/27, 55

[56] References Cited

U.S. PATENT DOCUMENTS

| | | | |
|---|---|---|---|
| 1,158,072 | 10/1915 | Niermeyer | 66/27 |
| 2,012,607 | 8/1935 | Housman | 66/55 |
| 3,388,563 | 6/1968 | Mishcom | 66/27 |
| 4,331,007 | 5/1982 | Marchisio | 66/55 |
| 5,018,370 | 5/1991 | Tsuchiya | 66/55 |

FOREIGN PATENT DOCUMENTS

| | | | |
|---|---|---|---|
| 1008860 | 5/1957 | Fed. Rep. of Germany | 66/55 |
| 1490120 | 4/1965 | France | 66/27 |
| 2061329 | 5/1981 | United Kingdom | 66/27 |
| 2156866 | 10/1985 | United Kingdom | 66/55 |

*Primary Examiner*—Clifford D. Crowder
*Assistant Examiner*—John J. Calvert
*Attorney, Agent, or Firm*—Bell, Seltzer, Park & Gibson

[57] ABSTRACT

An automatic stitch adjusting mechanism for use in a multiple knitting station circular knitting machine having a plurality of knitting needles supported in a rotating needle cylinder for vertical movement parallel to the axis of rotation of the needle cylinder is disclosed. A plurality of raising cams engage the needles for raising the needles. A plurality of stitch cams engage the needles for lowering the needles. The stitch cams are vertically movable for adjusting the size of the formed stitch. The automatic stitch adjusting mechanism includes a plurality of vertically movable stitch cam control members operatively connected to respective stitch cams. A drive motor connected by a belt and clutch mechanism to the stitch cam control members adjusts the vertical position of the control members and clutch mechanisms retain the control members in their adjusted positions.

4 Claims, 4 Drawing Sheets

AUTOMATIC STITCH ADJUSTING MECHANISM FOR CIRCULAR KNITTING MACHINE

CROSS-REFERENCE TO RELATED APPLICATIONS

This application is a continuation-in-part of application Ser. No. 07/712,465, filed Jun. 10, 1991, abandoned.

FIELD OF THE INVENTION

This invention relates generally to a mechanism for automatically adjusting the stitch cams on multiple knitting station circular knitting machines, and more particularly to such a mechanism in which a plurality of adjacent stitch cams are rapidly vertically adjusted by means of single drive motor.

BACKGROUND OF THE INVENTION

The stitch cams at each adjacent knitting station of a circular knitting machine are normally individually adjusted for changing the length of the formed stitches at each knitting station. Typically, the stitch cam at each knitting station is manually adjusted by rotating a screw or cam operatively connected to a movable support member on which the stitch cam is secured. In another proposed stitch cam adjustment mechanism, a rotary actuator operatively connected to the support member is adjusted for moving the support member and the stitch cam secured thereto.

These mechanisms have several drawbacks. Manually adjusting a screw or cam at each knitting station requires a high degree of skill and the final adjustment is critical so that the same length of stitch loop is drawn at each knitting station. A rotary actuator occupies the position on the knitting machine where multiple yarn feeders are placed so that the number of yarn feeders which may be provided on this type of knitting machine is reduced when a rotary stitch cam actuator is incorporated therein.

SUMMARY OF THE INVENTION

It is therefore an object of the present invention to provide an automatic stitch adjusting mechanism for use in circular knitting machines having multiple knitting stations and which overcomes the deficiencies of the prior art.

The automatic stitch adjusting mechanism in accordance with the present invention is provided on circular knitting machines having a plurality of knitting needles supported in a rotating needle cylinder for vertical movement of the needles parallel to the axis of rotation of the needle cylinder. A plurality of raising cams engage the needles for raising the needles, and a plurality of stitch cams engage the needles for lowering the needles. The stitch cams at adjacent knitting stations are vertically movable for adjusting the size of the stitch loops being formed at adjacent knitting stations.

In accordance with the present invention, the automatic stitch adjusting mechanism comprises a plurality of vertically movable stitch cam control members that are connected to respective stitch cams at each knitting station. A drive motor operatively connected to each of the stitch cam control members imparts vertical adjustive movement of selected magnitude to the stitch cam control members and stitch cams at each knitting station.

In a preferred embodiment, the stitch cam support members are slidably mounted on the knitting machine and are movable in a vertical direction. The stitch cams are mounted on the slidable stitch cam support members. A clutch is operatively connected to each stitch cam control member. When a respective clutch is engaged, the associated stitch cam control member is locked in a vertical position.

A lever member is pivotally connected through a shaft to the clutch. Upon pivotal movement of the lever, the clutch is engaged and disengaged from the stitch cam control member. Cams engage the lever and pivot the lever for opening and closing the clutch. A positioning plate member is movably connected to each stitch cam control member, and a threaded shaft is received through a threaded orifice at the positioning plate member. A drive pulley is fixed on the upper end of the shaft. A belt interconnects the pulley to a drive motor so that rotation of the threaded shaft by the belt and the drive motor moves the positioning plate and stitch cam control members, and thus adjusts the vertical position of the stitch cams. The motor works in cooperation with the cams and lever.

BRIEF DESCRIPTION OF THE DRAWINGS

Other objects and advantages will appear as the description proceeds when taken in conjunction with the accompanying drawings, in which.

DESCRIPTION OF THE PREFERRED EMBODIMENT

Figure 1:
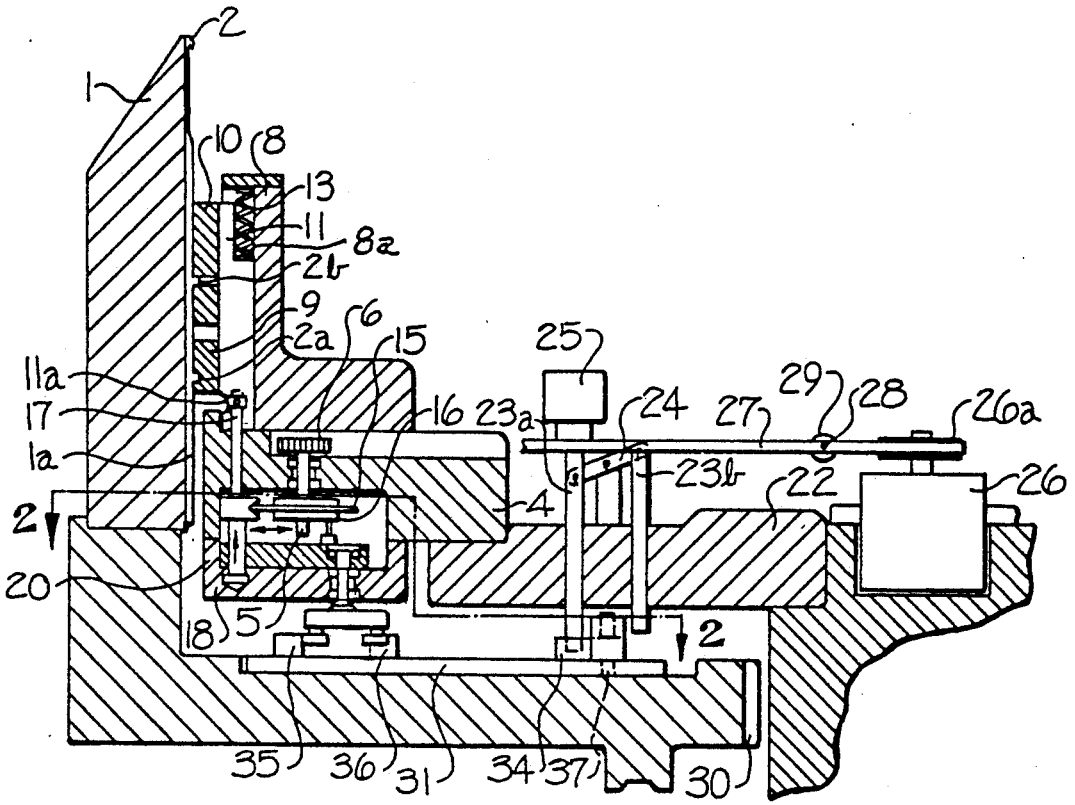
FIG. 1 is a fragmentary vertical sectional view through the needle cylinder of the knitting machine and illustrating the automatic stitch adjusting mechanism in accordance with the present invention.

As shown in FIG. 1, a rotating needle cylinder 1 is supported on a driven ring gear 30. The outside surface of the needle cylinder 1 is provided with the usual needle slots 1*a* in which needles, indicated at 2, are supported for vertical movement parallel to the axis of rotation of the needle cylinder 1. Each knitting needle 2 is provided with a raising butt 2*a* and stitch butt 2*b*.

Figure 15:
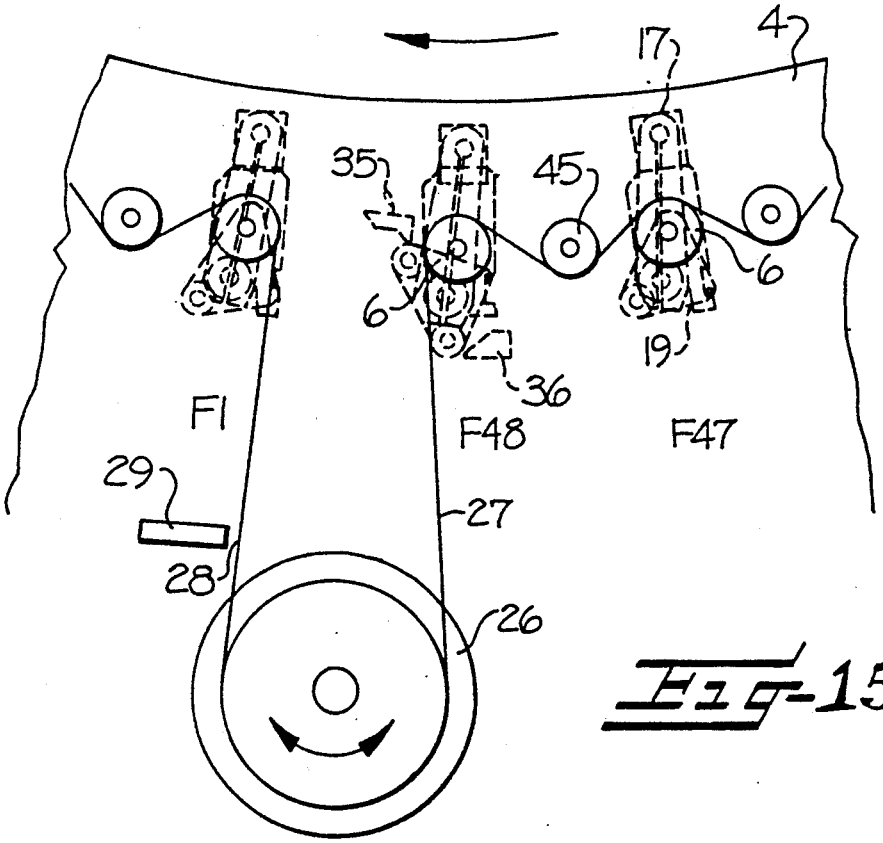
FIG. 15 is a fragmentary plan view showing the common belt interconnecting the pulleys of the threaded shafts, positioning plate members and stitch cam control members of adjacent knitting stations.

Cam holder plates 8 are supported on the upper surface of a cam holder ring 4 fixed on a cam ring plate 22. Raising cams 9 and stitch cams 10 are fixed to the inner surface of a needle rising and stitch cam support member 11. Stitch cam support member 11 is slidably mounted in the cam plate 8 for vertical movement. Needle rising cams 9 and stitch cams 10 are fixed on the movable stitch cam support member 11 and engage the respective rising butts 2*a* and stitch butts 2*b* of the needles 2 for successively raising and lowering the needles to a loop formation point while the yarn is fed at yarn feeding and knitting stations F1 through F48 (FIG. 15).

The cam plates 8 each include a square groove (or slot) 8*a* formed in its inner surface for supporting member 11 for vertical movement therein. A coil spring 13 is positioned in the groove 8*a* and engages the upper end of the movable stitch cam support member 11 for biasing the stitch cam support member 11 downwardly. Alternatively, an air cylinder or oil damper (not illustrated) can be positioned in the groove 8*a* for biasing the stitch cam support member 11 downwardly.

Figure 9:
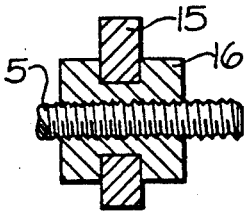
FIG. 9 is a sectional view taken along line 9—9 of FIG. 8 and showing the threaded shaft received in the guide plate member.
Figure 11:
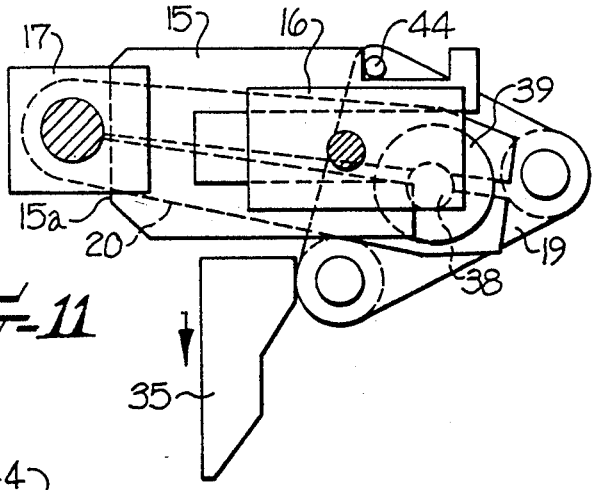
FIG. 11 is a view similar to FIG. 10 and showing the first operating cam fully engaging the first pivoting lever for opening the clutch.
Figure 12:
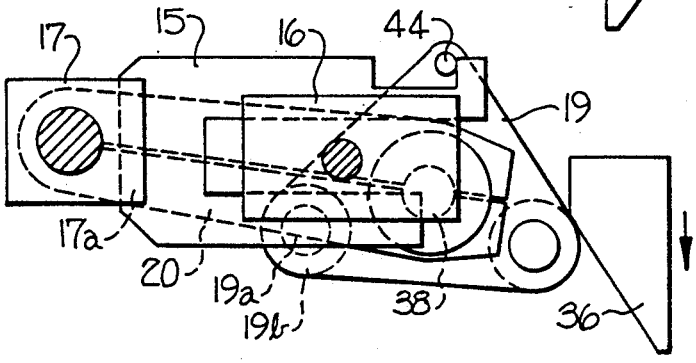
FIG. 12 is a fragmentary plan view similar to FIGS. 10 and 11 showing the second operating cam initially engaging the first pivoting lever and the guide plate control member moved rearward.

The first cam ring 4 includes a plurality of vertical shafts 5 having threaded lower portions received in openings of the first cam ring 4 at each yarn feed and knitting station. A pulley 6 is fixed on the top portion of each shaft 5 and positioned below the cam plates 8. A movable positioning plate member 15 and corresponding guide plate member 16 are received on the threaded lower portion of the shaft 5 (FIG. 9). Both members, 15 and 16, move up and down as the pulley 6 and shaft 5 are rotated. The plate 15 is movable forwardly and rearwardly relative to the guide plate member 16 and when moved forwardly, as shown in FIGS. 11 and 12, engages the notched portion of a vertically extending stitch cam control member 17.

Figure 4:
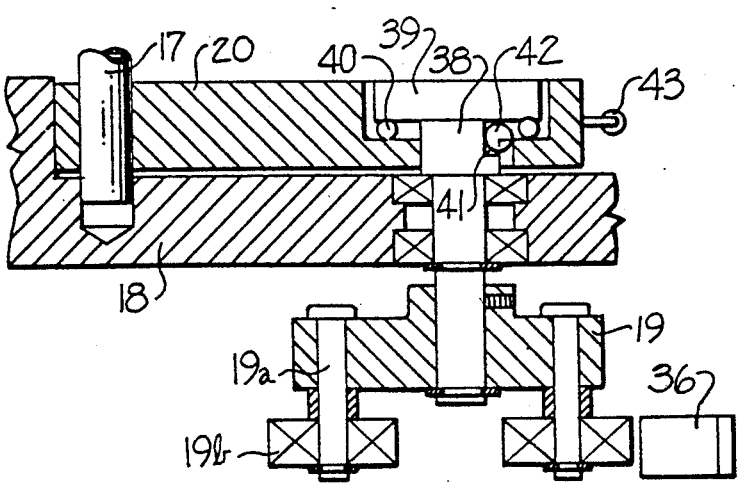
FIG. 4 is an enlarged, fragmentary sectional view of the clutch, lever and cams showing the clutch in a closed position.
Figure 5:
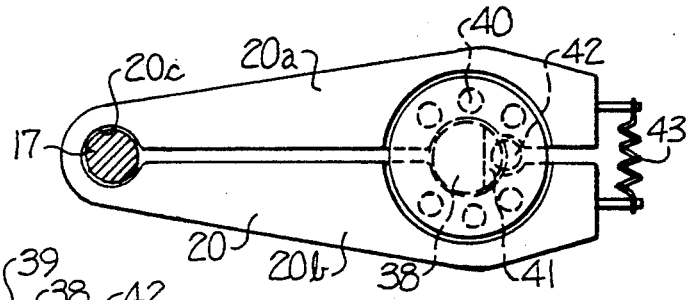
FIG. 5 is a fragmentary plan view of the clutch in a closed position and securing the stitch cam control member.

The stitch cam control member 17 extends upwardly, in the form of a vertical rod and extends upward through the first cam ring 4. The upper end of member 17 is fixed to the movable support member 11, as indicated at 11*a* in FIG. 1. Each member 17 is engaged adjacent its lower end by an elongate clutch assembly 20. As shown in greater detail in FIGS. 5–7, each clutch 20 includes two adjacent locking arm members 20*a* and 20*b* and an opening 20*c* at one end for surrounding and engaging the lower end portion of the associated stitch cam control member 17. A spring 43 fixed to the free opposite ends of arms 20*a*, 20*b* exerts a biasing force urging the arms toward each other for closing the clutch, i.e., forcing the arms 20*a* and 20*b* into frictional engagement with the lower portion of the stitch cam control member 17 (FIG. 5). A lever support shaft 38 extends vertically through the clutch 20, and through a first lever support member 18 underlying clutch 20 (FIG. 4). Shaft 38 is supported for rotation in lever support member 18. A triangular configured first lever 19 is fixed to the lower end portion of the shaft 38 and when pivoted, rotates the lower shaft 38 so as to effect opening and closing of clutch 20. A guide plate control rod 44 (FIGS. 8 and 10–13) extends upward from the triangular first lever 19. The upper end of rod 44 engages the movable positioning plate member 15 for moving the inner end 15*a* of the positioning plate member 15 into and out of engagement with a notch 17*a* of the stitch cam control member 17 as the lever 19 is pivoted. Support shafts 19*a* extend downwardly from apexes of lever 19 and each have cam follower rollers 19*b* at their lower ends.

Referring once again to FIG. 1, a pair of control pins 23*a*, 23*b* extend downwardly through the second cam ring 22. A rocking lever 24 is pivotally connected to the top portion of the control pins 23*a*, 23*b*. A solenoid 25 secured on the second cam ring 22 includes a solenoid output shaft (not shown) engaging the control pin 23*a* for moving the control pins 23*a*, 23*b* via the lever 24 when the solenoid 25 output shaft is displaced.

A reversible motor 26 is mounted on the knitting machine body (FIG. 1 and 15). A pulley 26*a* is mounted on the motor output shaft. A belt 27, preferably having perforations to prevent slipping, interconnects with teeth on motor pulley 26*a* and each pulley 6 mounted on the shafts 5 extending through respective positioning plate members 15 at the yarn feed and knitting stations. Rotation of the output shaft of motor 26 causes belt 27 to rotate the shafts and pulleys 5 and 6 a preselected extent. An initial indicia mark 28 (FIG. 15) is fixed on the belt 27 for indicating an initial reference point. A sensor 29 secured on the second cam ring 22, senses the initial indicia mark 28 for sensing the position of the belt 27 relative to rotation of the pulleys 6. The sensor 29 is operatively connected to the reversible motor, and generates signals to the motor indicative of the belt position for ensuring proper positioning of the stitch cams.

Figure 2:
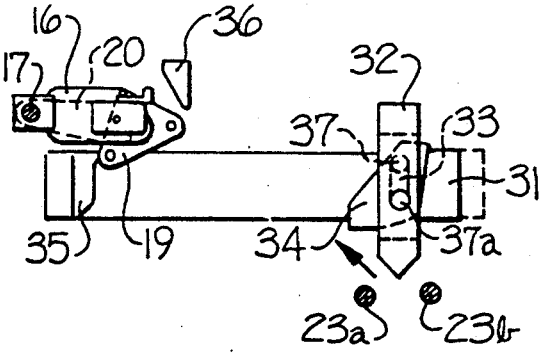
FIG. 2 is a fragmentary sectional plan view taken along line 2—2 of FIG. 1 and showing the working of the cams and levers.
Figure 3:
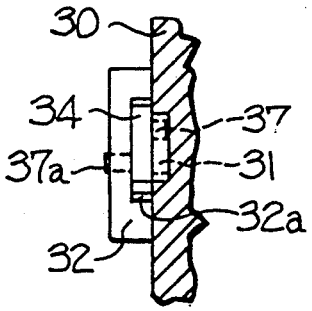
FIG. 3 is an end view looking at the righthand end of FIG. 2.

A radially displaceable second lever support plate member 31 is slidably mounted on the upper surface of the gearing assembly 30 (FIGS. 1 and 2). A second lever holder member 32 is pivotally mounted on the upper surface of the displaceable lever support plate member for controlling displacement of the plate member 31 (FIG. 2). A triangular configured second lever 34 is pivotally mounted in a recess 32*a* formed on the bottom portion of the second lever holder member 32 (FIGS. 2 and 3). The triangular configured second lever 34 includes a projection 37 positioned on the bottom surface and a second projection 37*a* positioned on the upper surface and serving as a fulcrum surface for pivoting the second lever 34. First and second operating cams 35, 36 on the rear portion of the second lever support plate 31 are adapted to engage the cam follower rollers 19*b* positioned on the first lever 19 as the movable plate 31 is displaced (FIG. 1).

When the solenoid 25 is energized, (FIG. 2), the control pin 23*a* is depressed engaging the second lever 34. At this time, the bottom projection 37 of the second lever 34 moves into an oblong hole 33 of the movable plate member 31 forcing the plate member 31 in a direction toward the outer periphery of the knitting machine. As the plate member 31 is moved in this direction, the first operating cam 35 acts on the first lever 19 (FIG. 2).

Referring now to FIG. 4, there is shown in greater detail the operating relationship between the clutch 20 and first lever 19. Steel ball bearings 40 are positioned along the lower surface of the circumference of a flange 39 formed on the upper portion of the support shaft 38. A larger steel ball bearing 42 is positioned in a recess 41 defined by cut-away portions of the clutch 20 and shaft 38. When the large ball bearing 42 is positioned in the recess 41, the first lever 19 is positioned where the second operating cam 36 may act on the cam follower 19*b*. As shown in FIG. 5, the large ball bearing 42 is out of engagement with the arms 20*a*, 20*b* of the clutch 20 and the spring 43 biases the clutch 20 for clamping and holding secured the lower end of the stitch cam control member 17.

Figure 6:
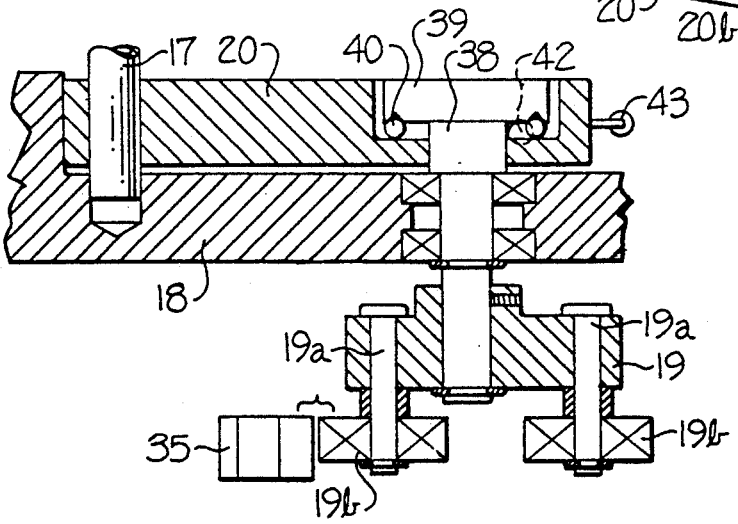
FIG. 6 is a view similar to FIG. 4 but showing the clutch in an open position.
Figure 7:
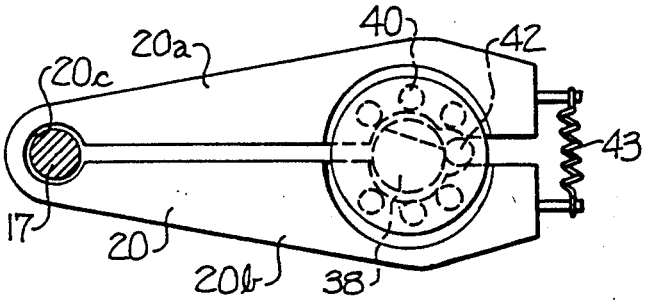
FIG. 7 is a view similar to FIG. 5 but showing the clutch in an open position, thus freeing the stitch cam control member for vertical movement.

As shown in FIG. 6, when the shaft 38 is rotated slightly by action of the cams 35, 36, the larger steel ball bearing 42 is displaced outward from the shaft and moved out of the recess 41. The clutch 20 is opened (FIG. 7) and the stitch cam control member 17 is no longer secured, but is free for adjustment as desired.

Figure 8:
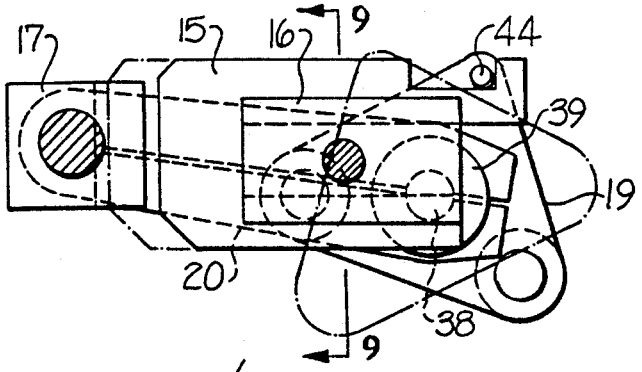
FIG. 8 is a fragmentary plan view showing the first lever pivoted in the position where the clutch is closed and engaged.
Figure 10:
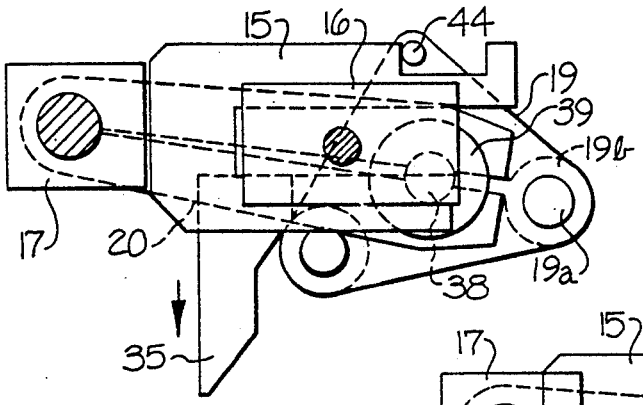
FIG. 10 is a fragmentary plan view showing the first operating cam initially engaging the first lever so that the guide plate control member is moved forward.

FIGS. 8–13 illustrate the sequence of steps by which first and second operating cams 35, 36 act on the first lever member 19 for opening and closing each clutch 20. The clutch 20 is shown in FIG. 8 in its closed condition. When actuation of solenoid 25 moves pins 23*a*, 23*b* and plate 31, the first operating cam 35 engages cam follower roller 19*b* and the first lever 19 pivots outwardly in the direction of the arrow shown in FIG. 10. The shaft 38 is rotated slightly, moving the large ball bearing 42, and opening the clutch 20 as illustrated in FIG. 10. As the first operating cam 35 moves downward and pivots the first lever 19, the guide plate control rod 44 is moved laterally. The guide plate control rod 44 forces the inner tip 15*a* of the positioning plate member 15 into the notch 17*a* on the stitch cam control member so that the stitch cam control member 17 is vertically displaced to an elevation determined by the adjusted elevation of guide plate member 16.

Figure 13:
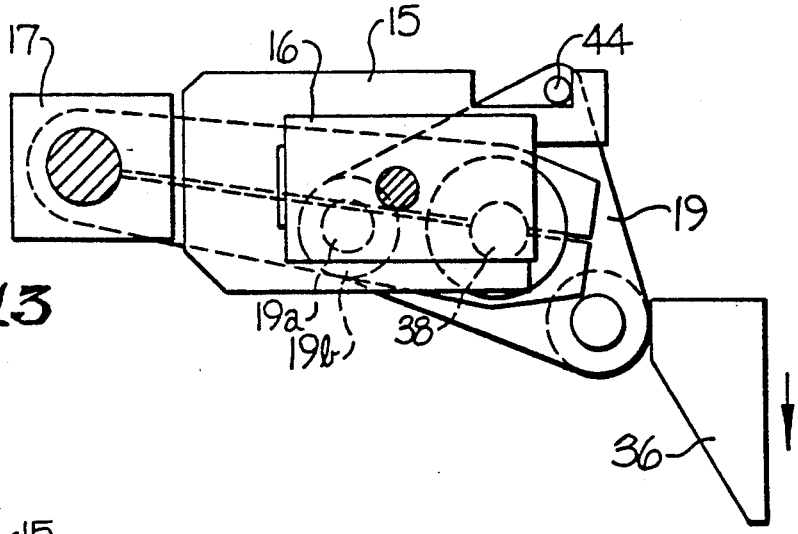
FIG. 13 is a view similar to FIG. 12 and showing the second operating cam fully engaging the clutch lever for closing the clutch.
Figure 14:
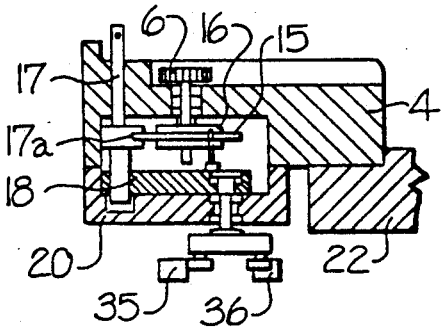
FIG. 14 is a fragmentary sectional view of a portion of FIG. 1 and showing in detail the automatic stitch adjusting mechanism.

As rotation of ring gear 30 continues, the second operating cam engages the other cam follower roller 19*b* (FIG. 12) and forces the guide plate control rod 44 rearward. At the same time, the clutch 20 is closed and secures the lower end of the stitch cam control member 17. As the second operating cam 36 moves downward, the guide plate control rod 44 returns the positioning plate member 15 to its normal outward position (FIG. 13).

Referring now to FIG. 15, there is illustrated in greater detail a fragmentary plan view of the knitting machine and showing in greater detail the operation of the stitch cam adjustment mechanism in accordance with the present invention. As illustrated, idler pulleys 45 are positioned along the midsection of the path of travel of the belt 27 for providing tension onto the various pulleys 6 at the individual yarn feed areas. As illustrated, the first and second operating cams, 35, 36, have passed the 47th yarn feeder F47 and are in a normal idle state.

As the needle cylinder 1 continues to rotate, at the 48th yarn feeder, F48, cam 35 engages and pivots lever 19. The first yarn feeder F1 is in the idle state similar to the 47th yarn feeder F47. The second operating cam 36 at the 48th yarn feeder F48 has finished acting on the cam follower rollers 19*b*. Timing is monitored by conventional means (not illustrated). The yarn feeders are brought into the idle state and the output shaft of the motor 26 rotates a predetermined amount for setting each of the stitch cams for the next knitting cycle. The sensor 29 indicates position of the indicia 28 for ensuring proper movement of the belt 27 as well as confirming the amount of variation between the desired movement of the belt 27 for adjusting the stitch cam.

Although only a single drive motor 26 and drive belt 27 are employed, individual adjustment of the elevations of the stitch cams at each of the knitting stations is possible. This is due to the fact that while all of the positioning plates 15 undergo simultaneous adjustive vertical movement, the stitch cam control member 17 adjacent each plate 15 will undergo vertical adjustive movement only when plate 15 is moved horizontally into mated engagement with it.

As disclosed, the automatic stitch cam adjustment mechanism in accordance with the present invention is advantageous over other prior art mechanisms mentioned before. The mechanism can be used on knitting machines having a large number of yarn feeders and eliminates the requirements for skilled operation in the individual adjustment of the stitch cams.

In the drawings and specification there has been set forth the best mode presently contemplated for the practice of the present invention, and although specific terms are employed, they are used in generic and descriptive sense only, and not for purposes of limitation, the scope of the invention being defined in the claims.

THAT WHICH IS CLAIMED IS:

1. In a circular knitting machine including a plurality of knitting needles supported in a rotating needle cylinder for vertical movement parallel to the axis of rotation of the needle cylinder, a plurality of raising cams engaging the needles for raising the needles, and a plurality of stitch cams engaging the needles for lowering the needles, said stitch cams being vertically movable for adjusting the size of the stitch, an automatic stitch adjusting mechanism for automatically changing the vertical height of the stitch cams comprising a plurality of vertically movable stitch cam control members, means operatively connecting each of said stitch cam control members to respective stitch cams, a drive motor, and means operatively connecting each of said stitch cam control members to said drive motor whereby actuation of said drive motor moves said stitch cam control members and said stitch cams in a vertical direction.

2. A circular knitting machine according to claim 1 wherein said means operatively connecting each of said stitch cam control members to respective stitch cams includes a support member slidably mounted on said knitting machine and movable in a vertical direction.

3. A circular knitting machine according to claim 1 wherein said means operatively connecting each of said stitch cam control members to said drive motor includes clutches connected to respective ones of said stitch cam control members, each of said clutches, when engaged, locking said stitch cam control member in a vertical position, a lever, means operatively connecting said lever to said clutch wherein upon pivotal movement of said lever said clutch is engaged and disengaged from said stitch cam control member, and cam means for engaging said lever and pivoting said lever for engaging and disengaging said clutch from said stitch cam control member.

4. A circular knitting machine according to claim 1 wherein said means operatively connecting each of said stitch cam control members to said drive motor comprises a positioning plate member slidably movable into engagement with said stitch cam control member, a guide plate member operatively connected to said positioning plate member, and means for moving said positioning plate member into engagement with said stitch cam control member.

* * * * *